US009403383B1

(12) United States Patent
Liu et al.

(10) Patent No.: US 9,403,383 B1
(45) Date of Patent: Aug. 2, 2016

(54) INK AND MEDIA TREATMENT TO AFFECT INK SPREAD ON MEDIA TREATED WITH PRIMER IN AN INKJET PRINTER

(71) Applicant: Xerox Corporation, Norwalk, CT (US)

(72) Inventors: Chu-Heng Liu, Penfield, NY (US); Anthony S. Condello, Webster, NY (US); Jeffrey J. Folkins, Rochester, NY (US); Christopher G. Lynn, Wolcott, NY (US); Daniel J. McVeigh, Webster, NY (US); Jason Hang, Geneva, NY (US); Joseph M. Ferrara, Jr., Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/866,028

(22) Filed: Sep. 25, 2015

(51) Int. Cl.
*B41J 11/00* (2006.01)
*B41J 2/01* (2006.01)

(52) U.S. Cl.
CPC ..... *B41J 11/0015* (2013.01); *B41J 2/01* (2013.01); *B41J 11/002* (2013.01)

(58) Field of Classification Search
CPC ..... B41J 3/543; B41J 5/0011; B41J 5/0017; B41J 11/002; B41J 11/0015; B41M 7/0081; B41M 7/009; C09D 11/30; C09D 11/101
USPC ..... 347/16, 21, 102, 104
See application file for complete search history.

(56) References Cited

U.S. PATENT DOCUMENTS 5,287,123 A * 2/1994 Medin ..... B41J 11/002 347/102
5,784,090 A 7/1998 Selensky et al.
6,508,552 B1 1/2003 Steinfield et al.
6,786,589 B2 * 9/2004 Suzuki ..... B41J 11/002 347/101
7,080,900 B2 * 7/2006 Takabayashi ..... B41J 11/002 347/102
7,104,627 B2 9/2006 Weast
7,419,232 B2 * 9/2008 Hoshino ..... B41J 2/2132 347/102
7,530,684 B2 * 5/2009 Yamanobe ..... B41J 2/2114 347/100
7,682,014 B2 3/2010 Snyder et al.
7,914,108 B2 * 3/2011 Konno ..... B41J 2/2114 347/100
8,215,744 B2 * 7/2012 Yamanobe ..... B41J 2/2114 347/21
8,297,729 B2 * 10/2012 Fujisawa ..... B41J 2/2114 347/102
8,376,542 B2 2/2013 Pedemonte et al.
2004/0196322 A1 * 10/2004 Nakajima ..... B41J 11/002 347/14
2011/0298876 A1 * 12/2011 Takeuchi ..... B41J 11/0015 347/102

FOREIGN PATENT DOCUMENTS

EP 1 306 223 A2 5/2003

* cited by examiner

*Primary Examiner* — Anh T. N. Vo
(74) *Attorney, Agent, or Firm* — Maginot Moore & Beck LLP

(57) ABSTRACT

A printer comprises an applicator, a primer dryer, a plurality of printheads, an auxiliary dryer configured to at least partially dry ink ejected by the plurality of printheads, a main dryer configured to dry ink ejected by the plurality of printheads, a media transport configured to move media past each of these components, and a controller. The controller operates the applicator to apply a predetermined amount of primer to a surface of media, the primer dryer at a predetermined temperature to dry the primer, the plurality of printheads to eject ink to the surface of media, the auxiliary dryer at a predetermined temperature to at least partially dry the ink ejected by the printheads to control the spread of ink, and the main dryer to dry the ink image. The controller uses a plurality of set points corresponding to printing process parameters identified for each print job.

18 Claims, 5 Drawing Sheets

INK AND MEDIA TREATMENT TO AFFECT INK SPREAD ON MEDIA TREATED WITH PRIMER IN AN INKJET PRINTER

TECHNICAL FIELD

This disclosure relates generally to inkjet printers, and, in particular, to systems and methods for controlling ink drop spread on coated media in inkjet printers.

BACKGROUND

Inkjet printing machines or printers include at least one printhead that ejects drops of liquid ink onto the surface of media. An inkjet printer employs inks in which pigments or other colorants are suspended in a carrier or are in solution with a solvent. The solvent may be water based, as in aqueous inks, or non-water based, as in non-aqueous inks. The amount of spread of ink drops ejected onto media affects the quality of the ink image formed. The spread of aqueous ink drops can be large enough to affect image quality adversely, particularly on coated media, such as papers having glossy, semi-glossy, or matte surfaces. These coated media are sometimes called offset paper and the interaction of aqueous ink with the surface of offset paper can be problematic. For example, aqueous ink ejected onto offset papers having glossy or semi-glossy surfaces often does not penetrate the media or get absorbed properly. The glossy or semi-glossy surfaces are water resistant because the surfaces have a relatively low porosity or permeability compared to uncoated papers. Consequently, the individual ink drops, which dry primarily by evaporation of water in the ink, slowly spread laterally across the surface of the coating before drying. If the drops are not dry enough and, consequently, are too mobile after they have joined with adjacent drops, a possibility exists of disturbing or moving the ink in these areas so the basic positions of these drops, the uniformity of the thickness of the inks at various positions, or both are affected. These conditions are commonly known as "coalescing" and "puddling" of the ink drops and noticeably impacts print quality. Because coalesced or puddled ink drops exhibit uneven thicknesses and drying characteristics they may also be undesirably transferred to other surfaces with which the media comes into contact, such as other paper in a sheet fed printing process. Moreover, when inks dry too slowly, two different colors of ink ejected adjacent each other tend to bleed into one another producing a defect known as "intercolor bleed."

Another example of the interaction of aqueous ink with offset papers occurs with offset papers having a matte finish. This type of surface often absorbs ink too deeply into the paper since the matte surfaces are more porous than glossy paper. Thus, media with matte surfaces permit deeper penetration of ink that other media finishes, especially when aqueous ink is used since aqueous ink has high water content. Accordingly, the printed image may lose color richness. Localized differences in the water content of media can also result in undesirable paper cockle.

To address these issues with offset papers, some inkjet printers apply a primer coating to offset papers before ejecting liquid ink onto the media to control ink spreading while reducing ink coalescence and puddle formation. As used in this document, "primer" refers to a material that when dried or partially dried on the surface of paper or media modifies the surface properties, such as the surface tension and the like so when ink is applied to the surface the ink spreads properly and uniformly coats the media or paper surface. Primers can be applied using a variety of methods, such as spraying, roller application, ejector coating, and the like. The intent of applying primer is generally to cause ink drops to spread more than they would without the primer, but not to spread excessively or to non-uniformly. The application of the primer coating, however, is not always effective as aqueous ink drops sometimes spread excessively on the surface of primer coating. Several factors affecting ink drop spreading include the type of primer coating and ink used, the thickness, weight, or amount of primer applied, dryness and temperature conditions of the media, and the amount of time required to dry the ink after it lands on the media. In some inkjet printers, primer coating has been applied to address ink drop spreading on the media. In some of these cases, however, the primer coating does not consistently achieve adequate ink drop spreading. Thus, a system or method that enables ink spread to be tuned for plastic medias, offset papers, and uncoated media treated with primer is desirable.

SUMMARY

A printer that improves ink spread on media treated with primer includes at least one actuator configured to operate a media transport to move media through the printer, an applicator configured to apply primer to a surface of the media as the media transport moves the media past the applicator, a first dryer positioned to dry primer applied to the surface of the media as the media transport moves the media past the first dryer, a plurality of printheads, each printhead in the plurality of printheads having a plurality of ejectors configured to eject ink drops onto the primer on the surface of the media as the media transport moves the media past the plurality of printheads, a second dryer configured to dry ink drops ejected by the plurality of printheads onto the media as the media transport moves the media past the second dryer, and a controller operatively connected to the at least one actuator, the applicator, the first dryer, the plurality of printheads, and the second dryer. The controller is configured to operate the at least one actuator to enable the media transport to move the media past the applicator, the first dryer, the plurality of printheads, and the second dryer, the controller being further configured to operate the applicator to apply a predetermined amount of primer to the surface of the media, to operate the first dryer at a first predetermined temperature to dry the primer on the surface of the media, to operate with reference to image data the plurality of ejectors in the plurality of printheads to eject ink drops onto the surface of the media to form an ink image on the surface of the media, and to operate the second dryer at a third predetermined temperature to dry the ink drops ejected by the plurality of printheads onto the media, the controller further being configured to operate the at least one actuator, the first dryer, and the main dryer to control spread of the ink drops on the media with reference to a plurality of set points selected with reference to at least one printing process parameter.

A method of operating a printer that improves ink spread on media treated with primer includes operating with a controller at least one actuator to operate a media transport that moves media past an applicator configured to apply primer to a surface of the media, past a first dryer positioned to dry primer applied by the applicator to the surface of the media, past a plurality of printheads, each printhead having a plurality of ejectors, and past a second dryer configured to dry ink ejected by the plurality of printheads, operating with the controller the applicator to apply a predetermined amount of primer to the surface of the media, operating with the controller the first dryer at a predetermined temperature to dry primer applied to the surface of the media, operating with the controller the plurality of printheads to eject ink drops from the plurality of ejectors onto the primer on the surface of media to form an ink image on the surface of the media, and operating with the controller the second dryer to dry the ink drops ejected by the plurality of printheads, the controller operating the applicator to apply the predetermined amount of primer, to operate the first dryer at the first predetermined temperature, and to operate the second dryer to dry the ink drops on the media with reference to a plurality of set points corresponding to at least one printing process parameter.

BRIEF DESCRIPTION OF THE DRAWINGS

The foregoing aspects and other features of a printing system that controls the spreading of ink drops ejected by printheads onto media treated with primer coatings are explained in the following description, taken in connection with the accompanying drawings.

DETAILED DESCRIPTION

Figure 1A:
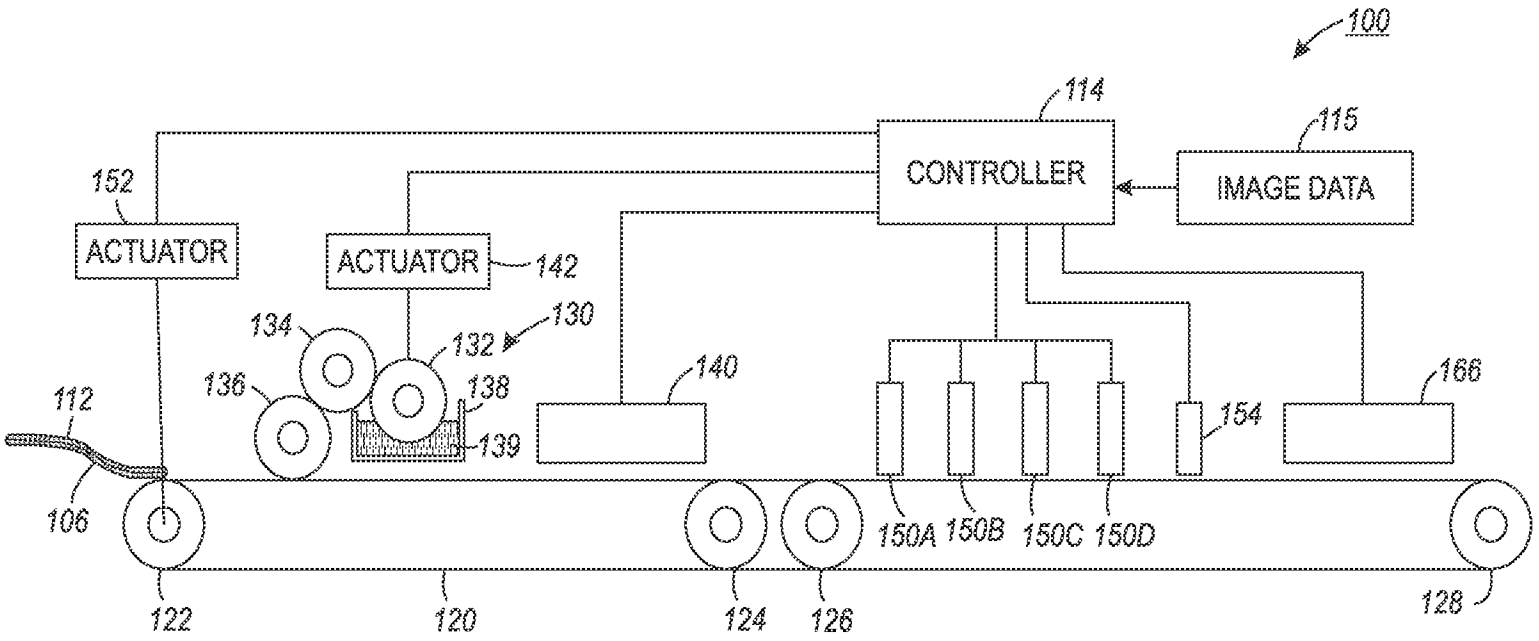
FIG. 1A is a schematic drawing of an inkjet printer that applies primer coating to media and treats the media with an auxiliary dryer.

For a general understanding of the present embodiments, reference is made to the drawings. In the drawings, like reference numerals have been used throughout to designate like elements. As used herein, the terms "printer," "printing device," or "imaging device" generally refer to a device that produces an image on print media with aqueous ink and may encompass any such apparatus, such as a digital copier, bookmaking machine, facsimile machine, multi-function machine, direct to object label press, or the like, which generates printed images for any purpose. "Image data" refers to information in electronic form that are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Aqueous inkjet printers use inks that have a high percentage of water relative to the amount of colorant and solvent in the ink.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are staggered in diagonal rows across a face of the printhead. Various printer embodiments include one or more printheads that form ink images on an image receiving surface. Some printer embodiments include a plurality of printheads arranged in a print zone. An image receiving surface, such as an intermediate imaging surface, moves past the printheads in a process direction through the print zone. The inkjets in the printheads eject ink drops in rows in a cross-process direction, which is perpendicular to the process direction in the plane of the media. "Process direction" refers to the direction in which the image receiving surface is moving. As used in this document, the term "aqueous ink" includes liquid inks in which colorant is in a solution, suspension or dispersion with a liquid solvent that includes water and one or more liquid solvents. The terms "liquid solvent" or more simply "solvent" are used broadly to include liquids that dissolve colorants into a solution or that hold particles of colorant in a suspension or dispersion without dissolving the colorant.

As used in this document, the term "dryer" refers to a device that generates airflow, energy, or both. The generated energy can be heat or curing radiation. Generated heat can include radiant, convective, conductive, or a combination of these types of heat. Curing radiation is ultraviolet radiation useful for curing liquid photopolymer. A dryer can produce an amount of heat that alters the temperature of the media or object passing the dryer, or a dryer can produce an amount of heat that maintains the media or object at a predetermined temperature.

FIG. 1A illustrates a high-speed aqueous inkjet printer 100 with features that aid in limiting ink spread and that reduce or eliminate excessive coalescence and puddling of printed ink on plastic medias, offset papers, and uncoated papers to which a primer coating is applied before printing. As illustrated, the printer 100 is the type that ejects ink drops directly onto a surface of media 106, which may be offset paper media or uncoated paper media, and includes a mechanical de-curler 112, an electronic subsystem (ESS) or controller 114, an endless belt 120 with rollers 122, 124, 126, 128, a primer pre-coater 130, a primer dryer 140, actuators 142, 152, a plurality of printhead modules 150A-150D, an auxiliary dryer 154, and a main dryer 166.

Controller 114 is operatively connected to actuators 142, 152, primer dryer 140, printhead modules 150A-150D, auxiliary dryer 154, and main dryer 166. Controller 114 is, for example, a self-contained, dedicated computer having a central processor unit (CPU) with electronic storage, and a display or user interface (UI). Controller 114 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits. The controller 114 generates electrical signals to operate one and possibly more actuators 152 to drive one or more rollers 122, 124, 126, 128 about which the endless belt 120 is entrained to move the endless belt about the rollers. The endless belt 120 moves media 106 past the primer pre-coater 130, the primer dryer 140, printhead modules 150A-150D, the auxiliary dryer 154, and the main dryer 166. While the media transport is depicted with an endless belt 120 to transport media sheets, the actuators 152 can be configured to drive a series of rollers, with or without an endless belt, to transport a continuous web of media.

The primer pre-coater 130 in the embodiment shown is an offset type apparatus configured as an applicator of primer 139 to media 106. The pre-coater 130 includes a metering roller 132, which is partially submerged in a sump 138 containing primer 139, an anilox roller 134, and a blanket roller 136. An outer surface of metering roller 132 engages an outer surface of anilox roller 134, and the outer surface of anilox roller 134 engages an outer surface of blanket roller 136. The blanket roller 134 is positioned to engage a surface of media 106 as the media passes by the primer pre-coater 130 on endless belt 120. Actuator 142 is operatively connected to metering roller 132. Controller 114 operates actuator 142 to rotate metering roller 132, which causes anilox roller 134 and blanket roller 136 to rotate. This rotation enables the metering roller 132 to transfer primer 139 to roller 134, which delivers primer to roller 136. Primer on the outer surface of blanket roller 136 is transferred to the surface of media 106 as the media passes the roller 136 during operation of the pre-coater 130. The controller 114 is configured to control the amount of primer applied to the surface of the media. The amount of applied primer is sometimes referred to as "primer coat weight" in this document. The primer coat weight is varied to optimize the spread of ink drops ejected onto the media by the printheads and to control the amount of media curl or cockle that results from varying primer coat weights. Alternatively, the pre-coater system 130 can be implemented with inkjet printheads that eject primer fluid onto the media or a vapor sprayer that sprays primer on the media. The primer coating weight is regulated by adjusting the composition of the primer with various additives, the speed at which the rollers are rotated, the firing signals for ejecting the primer, the pressure of the pneumatic pressure source for a sprayer, and the like.

Controller 114 also operates the primer dryer 140 to dry primer applied to media 106 by primer pre-coater 130. The degree of dryness of the primer affects the spread of the ink drops ejected onto the media by the printheads. Since the controller 114 is configured to vary the degree to which the primer is dried by the primer dryer 140, the degree of dryness is regulated to help control the amount of ink spread of the ink drops ejected onto the media by the printheads. In some embodiments, the controller 114 also controls the primer dryer 140 to preheat the media to a predetermined temperature prior to ejection of the ink drops onto the media by the plurality of printheads. The predetermined temperatures and airflows at which the controller operates the dryer 140 are determined empirically for various media types and ink types. By heat treating the media prior to printing, the spread of the ink drops that are subsequently ejected onto the media by the printheads can be further controlled.

Controller 114 is configured to receive image data from an image data source 115, such as a scanner or application program. The controller 114 renders the image data and generates firing signals that are used to operate inkjet ejectors in the printheads of the modules 150A-150D to eject ink drops. Although the printer 100 includes four printhead modules 150A-150D, each of which has two arrays of printheads, alternative configurations can include a different number of printhead modules or arrays within a module.

Figure 1B:
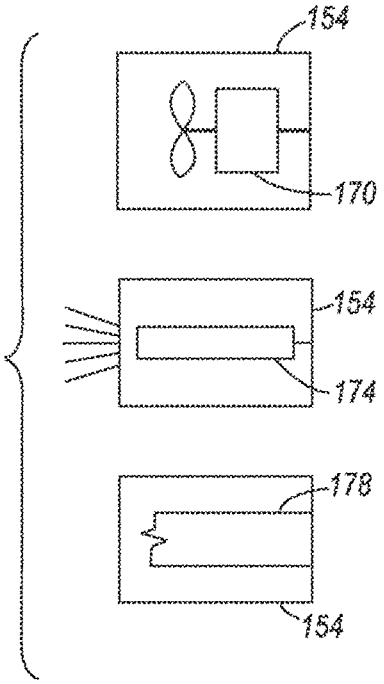
FIG. 1B depicts various embodiments of the auxiliary dryers.

The controller 114 further operates the auxiliary dryer 154 and the main dryer 166 to dry the media and the ink ejected by the printheads in a manner described in more detail below. As shown in FIG. 1B, auxiliary dryer 154 can be configured with a fan 170 to direct a cooling gas or fluid, such as air, towards the surface of media 106, a radiator 174 to direct electromagnetic radiation towards media 106, or an electrical heating element 178, such as an electrical resistance heating element, to direct heat towards paper. Other known types of dryers can also be used.

In the embodiment shown, main dryer 166 is configured to dry ink images formed on the surface of media 106 fully. Main dryer 166 is positioned near, but not immediately adjacent to, printhead modules 150A-150D. As in previously known inkjet printers, the main dryer 166 has a relatively large size that prohibits placement of the main dryer directly adjacent the printhead modules 150A-150D because the heat and air flow produced by the dryer 166 can adversely impact the printing of the ink image on the media beneath the printheads. Auxiliary dryers 154, however, are positioned immediately adjacent each side of the printhead modules 150A-150D. Auxiliary dryers 154 have a lower power rating and a smaller size relative to dryers 140 and 166, which enables the auxiliary dryers to be placed closer to the printhead modules 150A than the main dryer 166 and the primer dryer 140 without disrupting the printing of the ink image on the media. The auxiliary dryer 154 can be operated to help partially fix ink drops on the media to help control or eliminate ink drop spread. The controller 114 adjusts the electrical power delivered to the dryer 154 to regulate ink drop spread before the ink image on the media reaches the main dryer 166.

In operation of printer 100, the controller 114 detects receipt of a print job and selects the operational parameter set points for the printer components with reference to the print process parameters identified for the received print job. To commence the print job, media 106 is retrieved from media storage (not shown) and fed through mechanical de-curler 112 before reaching belt 120. Mechanical de-curler 112 is configured with an S-shaped bend path, as shown in FIG. 1A, to help attenuate any irregularities the media may have from its loading into the printer or its storage in the printer. The configuration of the de-curler 112 is particularly effective to reduce irregularities of the media in the cross process direction of media 106. Sheet irregularities include folds, creases, wrinkles, or any other curl present in the media caused by media mishandling and other environmental factors, such as humidity. Preexisting sheet input curl can be especially prevalent when cut-sheet media are used and the sheets are coated on one side only. In one embodiment, the curves in the S-shaped bend are symmetrical and have radii of between 5 to 20 mm (depending on the stiffness of substrate), which are useful to address sheet input curl in the first 3 to 5 inches of the media. The radii are at the lower end of this range for lower weights of media and at the higher end of the range for heavier weights of media. In other embodiments, another known type of de-curler is used, while in yet other embodiments no de-curler is implemented in printer 100.

After passing through mechanical de-curler 112, media 106 travels on endless belt 120 past the primer pre-coater 130 and primer dryer 140. Controller 114 operates actuator 142 with reference to the selected set points to drive the metering roller 132 in a manner that transfers a predetermined amount of primer 139 from primer bath 138 onto the surface of the media 106 through the interaction of the anilox roller 134 and blanket roller 136. The primer on the surface of the surface of media 106 is then dried to a desired degree by primer dryer 140, which is also operated by the controller 114 with reference to the selected set points.

Media 106 then travels on endless belt 120 beneath printhead modules 150A-150D. Controller 114 sends firing signals to printhead modules 150A-150D with respect to image data from image data source 115 to eject ink drops onto media 106 to form an ink image on the media. Immediately after passing by printhead modules 150A-150D, sheet media 106 passes under auxiliary dryer 154. Controller 114 can operate the auxiliary dryer 154 to heat treat the media and the ink drops on the media to control the spread of the ink drops on the media. This heat treatment can evaporate water from the ink, change the viscosity of the ink, or aid in adjusting the dryness of the media. Again, the controller 114 is configured to operate the auxiliary dryer 154 with reference to the selected set points that correspond to a number of printing process parameters as discussed below. The operation of the auxiliary dryer 154 partially dries the ink image formed on the surface of media 106 to control the spread of the ink drops on the surface of media 106. After media 106 passes by the auxiliary dryer 154, media 106 passes under main dryer 166 so main dryer 166 can fully dry the ink image stabilized on the media surface by the operation of one or both auxiliary dryers 154. While the printing process has described with reference to a sheet media printer, the process can be used to operate a continuous web printer, which does not include a de-curler.

The auxiliary dryer 154 is positioned so the time between ink ejection by the printhead ejectors and the drying of the ink drops and media by the auxiliary dryer 154 is reduced compared to the time between ink ejection and drying in previously known printers having only a main dryer 166 since the time between ink ejection and drying has been found to affect the spread of ink in some cases. For example, in those cases where too much time occurs between ink ejection and drying, the ink spreads too much and causes image quality defects such as coalescence, puddling, excessive line widths, and ragged line edges. As stated earlier, the printers having a main dryer could not be positioned to aid effectively in reducing ink drop spread since the main dryer has physical dimensions that prohibit the main dryer from being positioned directly adjacent the printhead modules. Accordingly, auxiliary dryer 154 of printer 100 reduces the undesired spread of aqueous ink drops on media treated with a primer coating. Because auxiliary dryer 154 does not fully dry the ink image, printer 100 still includes the main dryer 166 to finish drying the ink image.

In the printer 100, the controller 114 is configured to operate the actuator 142 to control the primer coat weight applied to the media 106 by the pre-coater 130, to operate the dryer 140 to dry the primer an appropriate amount and to heat treat the media prior to printing, and to operate the auxiliary dryer 154 to reduce the time between ejection of ink to the media and at least partially drying the ink drops to control the amount of ink spread on the media. The controller 114 is configured to select a plurality of set points for operating the printing process components with reference to one or more printing process parameters. The "printing process parameter," as used in this document, refers to any numerically definable aspect of the printing process. Printing process parameters include the type of media being printed, the image data used to operate the printheads, the speed of printing, a target image quality, the type of aqueous ink ejected by the printheads, the primer coating weight, and other definable aspects for the printing process that are identified for each print job. As used in this document, "target image quality" refers to a data value that identifies a level of quality to be achieved for an ink image on the media after the printing and fixing of the ink image to the media. The set points for control of the printing process include different predetermined speeds for actuator operation, temperatures for heaters and dryers to achieve media and ink temperatures at various locations in the process, operational parameters for components that affect primer coating weight, and the like. The predetermined values for the various operational parameters at which the controller 114 can operate the printer components are stored in the printer's memory and are selected with reference to the printing process parameters identified for a print job.

Figure 2:
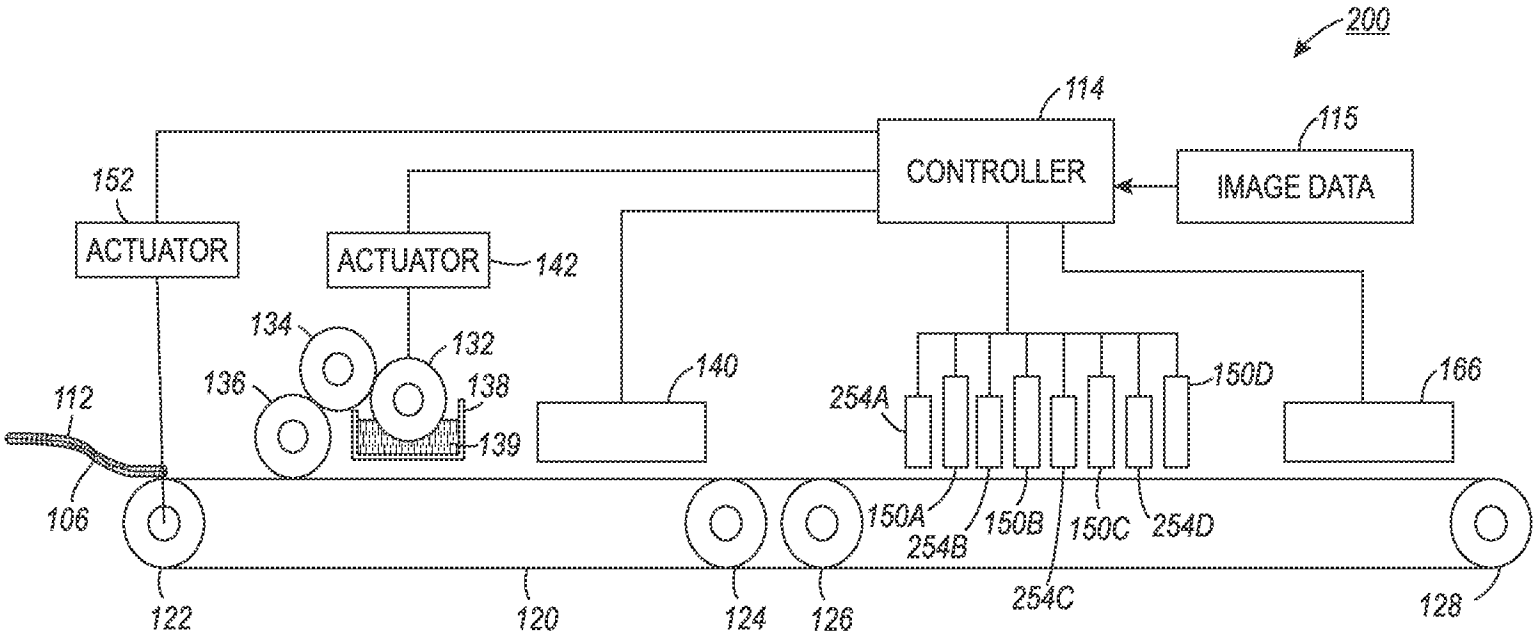
FIG. 2 is a schematic drawing of another inkjet printer that applies primer coating to media and treats the media with a plurality of auxiliary dryers.

FIG. 2 illustrates a high-speed aqueous ink printer 200 with features that aid in ink drop spread and that reduce or eliminate excessive coalescence and puddling of printed ink on plastic media, offset papers, and uncoated papers treated with a primer coating. As illustrated, the printer 200 is substantially similar to the printer 100 of FIG. 1, where like numbers correspond to like parts, including a mechanical decurler 112, an endless belt 120 with rollers 122, 124, 126, 128, a primer pre-coater 130, a primer dryer 140, actuators 142, 152, a plurality of printhead modules 150A-150D, and a main dryer 166. Printer 200 further includes a plurality of auxiliary dryers 254A-254D, and an electronic subsystem (ESS) or controller 214 operatively connected to the actuators 142, 152, primer dryer 140, printhead modules 150A-150D, auxiliary dryers 254A-254D, and main dryer 166.

The auxiliary dryers 254A-254D and printhead modules 150A-150D are placed in alternating order such that at least one of the auxiliary dryers is positioned between two adjacent printhead modules as shown in FIG. 2. The embodiment of printer 200 shown in FIG. 2 includes four auxiliary dryers. In other embodiments, one, two, three, five, six or any desired number of auxiliary dryers may be incorporated. Similar to auxiliary dryer 154 of printer 100, dryers 254A-254D have a lower power rating or have a size relatively smaller than dryers 140 and 166, which enables placement of the auxiliary dryers between and close to the printhead modules 150A-150D. Controller 214 can vary the electrical power delivered to the auxiliary dryers 254A-254D to achieve a desired amount of drying with reference to printing process parameters as defined previously.

In operation of printer 200, the controller 214 detects receipt of a print job and selects the operational parameter set points for the printer components with reference to the printing process parameters identified for the received print job. To commence the print job, media 106 is retrieved from media storage (not shown) and fed through mechanical de-curler 112 before reaching belt 120. After passing through mechanical de-curler 112, media 106 then travels on endless belt 120 beneath printhead modules 150A-150D and auxiliary dryers 254A-254D so the printheads in the modules can eject ink drops onto the media with reference to image data from image data source 115 and the auxiliary dryers 254A-254D can partially dry ink ejected by the printheads in the modules. Controller 214 is configured to use the selected set points to control the auxiliary dryers 254A-254D independently to enable the drying of ink drops immediately after ejection of ink from each individual printhead module. When each printhead module utilizes a different color, for example, the independently controllable auxiliary dryers provide for individual drying of each color to prevent individual colors from spreading. After media 106 passes by the auxiliary dryers 254A-254D, media 106 passes under main dryer 166, which completes the drying of the ink image. While the printing process has described with reference to a sheet media printer, the process can be used to operate a continuous web printer, which does not include a de-curler.

Like the controller 114 of printer 100 of FIG. 1, the controller 214 of printer 200 of FIG. 2 is configured to use the selected set points to operate the actuator 142 to control the primer coat weight applied to the media 106 by the pre-coater 130, to operate the dryer 140 to dry the primer an appropriate amount and to heat treat the media prior to printing, and to operate the auxiliary dryers 254A-254D to reduce the time between ejection of ink to the media and at least partially drying the ink drops to control the amount of ink spread on the media. The controller 214 is configured to operate these components at different speeds and temperatures with reference to the set points selected after the printing process parameters are identified as noted above. The predetermined values for the set points at which the controller 214 can operate these components are stored in the printer's memory.

Figure 3:
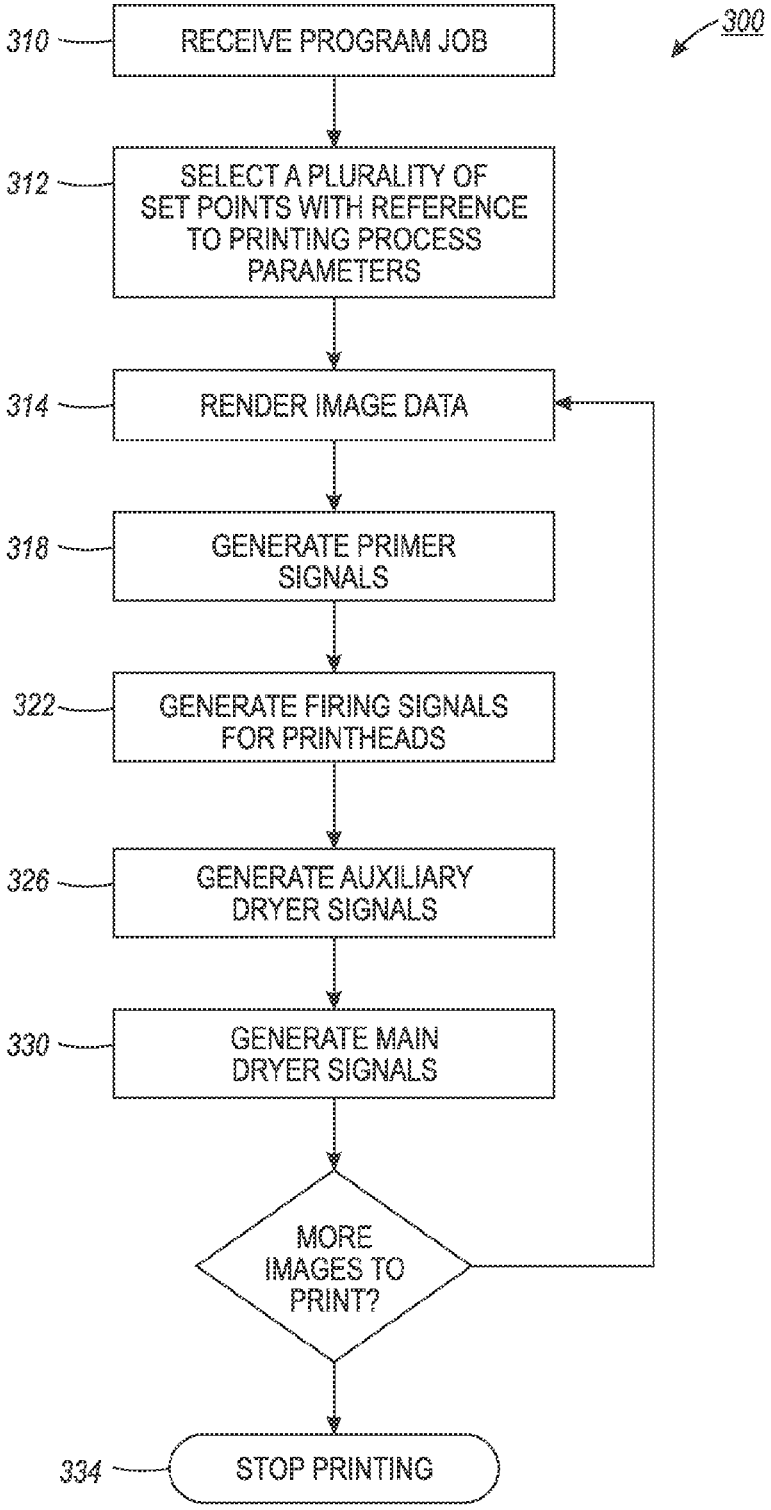
FIG. 3 is a flow diagram of a process for operating the inkjet printer of FIG. 1.
Figure 4:
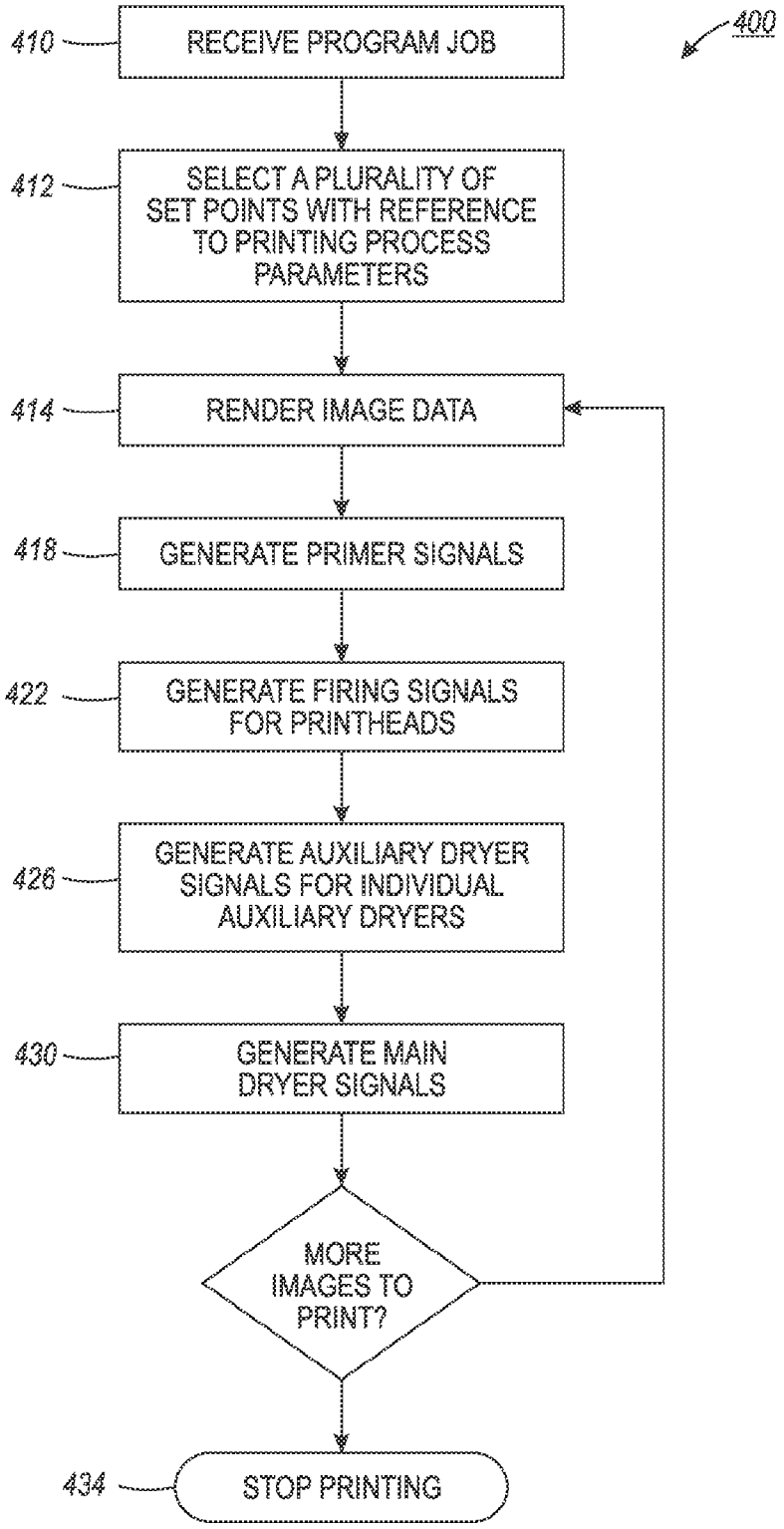
FIG. 4 is a flow diagram of a process for operating the inkjet printer of FIG. 2.

FIG. 3 depicts a process 300 for operating a printer, such as printer 100 of FIG. 1A, having an auxiliary dryer that reduces ink drop spread. FIG. 4 depicts a process 400 for operating a printer, such as printer 200 of FIG. 2, which uses auxiliary dryers dispersed between the printheads to reduce ink drop spread. In the following description of these processes, statements that a process is performing some task or function refers to a controller or general purpose processor executing programmed instructions stored in a memory operatively connected to the controller or processor to manipulate data or to operate one or more components in the printer to perform the task or function. The controllers 114, 214 noted above can be such a controller or processor. Alternatively, controllers 114, 214 can be implemented with more than one processor and associated circuitry and components, each of which is configured to form one or more tasks or functions described herein.

According to process 300 of FIG. 3, upon receipt of a printing job (block 310), process 300 receives data of image content to be printed along with the printing process parameters for the print job. The printing process parameters are used to select the set points for operating the components of the printer during the print job (block 312). The image data are rendered (block 314) to enable the controller to operate the ejectors in the printheads. The controller uses the selected set points to control the primer pre-coater 130 and the primer dryer 140 to transfer and dry primer 139 on portions of media where the image is to be printed (block 318). The controller 114 also generates firing signals for operating the printheads with reference to the rendered image data (block 322). The controller also sends signals to the auxiliary dryer 154 to activate the dryer to at least partially dry the ink image formed on the media (block 326), and sends signals to the main dryer 166 to activate the dryer to further or fully dry the ink image (block 330). If more image data are to be printed for the print job, the process continues with the rendering of additional image data (block 314). Otherwise, the printing operation ends (block 334).

According to process 400 of FIG. 4, upon receipt of a printing job (block 410), process 400 receives data of image content to be printed along with the printing process parameters for the print job. The printing process parameters are used to select the set points for operating the components of the printer during the print job (block 412). The image data are rendered (block 414) to enable the controller to generate the firing signals for operating the ejectors in the printhead. The controller uses the selected set points to control the primer pre-coater 130 and the primer dryer 140 to transfer and dry primer 139 on portions of media where the image is to be printed (block 418). The controller generates the firing signals for the printheads with reference to the rendered image data (block 422). The controller 214 simultaneously sends signals to the auxiliary dryers 254A-254D to activate dryers associated with printheads that ejected ink onto the media to at least partially dry the ink image formed on the media (block 426) and to send signals to the main dryer 166 to activate the dryer to further dry the ink image (block 430). If more image data are to be printed for the print job, the process continues with the rendering of additional image data (block 414). Otherwise, the printing operation ends (block 434). Again, the reader should remember that the controller implementing the process of FIG. 3 or FIG. 4 operates the various components with reference to the set points selected with reference to the printing process parameters identified for the print job.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

at least one actuator configured to operate a media transport to move media through the printer;

an applicator configured to apply primer to a surface of the media as the media transport moves the media past the applicator;

a first dryer positioned to dry primer applied to the surface of the media as the media transport moves the media past the first dryer;

a plurality of printheads, each printhead in the plurality of printheads having a plurality of ejectors configured to eject ink drops onto the primer on the surface of the media as the media transport moves the media past the plurality of printheads;

a second dryer configured to dry ink drops ejected by the plurality of printheads onto the media as the media transport moves the media past the second dryer; and a controller operatively connected to the at least one actuator, the applicator, the first dryer, the plurality of printheads, and the second dryer, the controller being configured to operate the at least one actuator to enable the media transport to move the media past the applicator, the first dryer, the plurality of printheads, and the second dryer, the controller being further configured to operate the applicator to apply a predetermined amount of primer to the surface of the media, to operate the first dryer at a first predetermined temperature to dry the primer on the surface of the media, to operate with reference to image data the plurality of ejectors in the plurality of printheads to eject ink drops onto the surface of the media to form an ink image on the surface of the media, and to operate the second dryer at a second predetermined temperature to dry the ink drops ejected by the plurality of printheads onto the media, the controller further being configured to select a plurality of set points with reference to at least one of a type of media being printed, image data used to operate the printheads, a speed of printing, a target image quality, a type of aqueous ink elected by the printheads, and a primer coating weight, and to operate the at least one actuator, the first dryer, and the second dryer to control spread of the ink drops on the media with reference to the selected plurality of set points.

2. The printer of claim 1 further comprising:

at least one auxiliary dryer positioned adjacent the plurality of printheads to enable the at least one auxiliary dryer to at least partially dry ink drops ejected by the plurality of ejectors onto the media as the media transport moves the media past the at least one auxiliary dryer, the at least one auxiliary dryer having a power rating that is less than a power rating of the first dryer and the second dryer; and the controller being operatively connected to the at least one auxiliary dryer, and the controller being further configured to operate the at least one auxiliary dryer at a third predetermined temperature to at least partially dry ink drops ejected by the plurality of printheads onto the media.

3. The printer of claim 2, the at least one auxiliary dryer positioned between two adjacent printheads in the plurality of printheads.

4. The printer of claim 2, the at least one auxiliary dryer comprising:

a plurality of auxiliary dryers, each auxiliary dryer in the plurality of auxiliary dryers being positioned between a different pair of adjacent printheads in the plurality of printheads, each auxiliary dryer being configured to at least partially dry ink drops ejected by the plurality of printheads.

5. The printer of claim 2, the at least one auxiliary dryer being positioned between the second dryer and the plurality of printheads, the at least one auxiliary dryer being configured to at least partially dry ink ejected by the plurality of printheads after the ink drops have been ejected onto the media to control spread of the ink drops on the media.

6. The printer of claim 2, the at least one auxiliary dryer further comprising:

a fan configured to direct a fluid towards the surface of the media.

7. The printer of claim 2, the at least one auxiliary dryer further comprising:

a radiator configured to direct electromagnetic radiation towards the surface of the media.

8. The printer of claim 2, the at least one auxiliary dryer further comprising:

an electrical heating element configured to direct heat towards the surface of the media.

9. The printer of claim 8, the electrical heating element being configured as an electrical resistance heating element.

10. A method of operating a printer comprising:

operating with a controller at least one actuator to operate a media transport that moves media past an applicator configured to apply primer to a surface of the media, past a first dryer positioned to dry primer applied by the applicator to the surface of the media, past a plurality of printheads, each printhead having a plurality of ejectors, and past a second dryer configured to dry ink ejected by the plurality of printheads;

operating with the controller the applicator to apply a predetermined amount of primer to the surface of the media;

operating with the controller the first dryer at a first predetermined temperature to dry primer applied to the surface of the media;

operating with the controller the plurality of printheads to eject ink drops from the plurality of ejectors onto the primer on the surface of media to form an ink image on the surface of the media;

selecting with the controller a plurality of set points with reference to at least one of a type of media being printed, image data used to operate the printheads, a speed of printing, a target image quality, a type of aqueous ink elected by the printheads, and a primer coating weight; and operating with the controller the second dryer at a second predetermined temperature to dry the ink drops ejected by the plurality of printheads, the controller operating the applicator to apply the predetermined amount of primer, operating the first dryer at the first predetermined temperature, and operating the second dryer at the second predetermined temperature to dry the ink drops on the media with reference to the selected plurality of set points.

11. The method of claim 10 further comprising:

operating the at least one actuator operating the media transport to move the media past at least one auxiliary dryer positioned adjacent the plurality of printheads, the at least one auxiliary dryer having a power rating that is less than the first and the second dryers; and operating with the controller the at least one auxiliary dryer at a third predetermined temperature to at least partially dry the ink ejected by the plurality of printheads to control spread of ink on the media, the controller operating the at least one auxiliary dryer at the predetermined temperature to control spread of ink ejected to the media.

12. The method of claim 11, the operating of the at least one auxiliary dryer further comprising:

operating with the controller the at least one auxiliary dryer positioned between two adjacent printheads in the plurality of printheads to at least partially dry ink ejected by the plurality of printheads.

13. The method of claim 11, the operating of the at least one auxiliary dryer further comprising:

operating with the controller a plurality of auxiliary dryers to at least partially dry the ink ejected by the plurality of printheads, each auxiliary dryer in the plurality of auxiliary dryers being positioned between different pairs of adjacent printheads in the plurality of printheads.

14. The method of claim 11, the operating of the at least one auxiliary dryer further comprising:

operating with the controller the auxiliary dryer that is positioned between the second dryer and the plurality of printheads to at least partially dry ink ejected by the plurality of ejectors after the ink has been ejected to the media and before the media passes the second dryer.

15. The method of claim 11, the operating of the at least one auxiliary dryer further comprising:

operating with the controller a fan to direct a fluid towards the surface of the media.

16. The method of claim 11, the operating the at least one auxiliary dryer further comprising:

operating with the controller a radiator to direct electromagnetic radiation towards the surface of the media.

17. The method of claim 11, the operating the at least one auxiliary dryer comprising:

operating with the controller an electrical heating element to direct heat towards the surface of the media.

18. The method of claim 17, the operating of the electrical heating element further comprising:

operating with the controller an electrical resistance element to direct heat towards the surface of the media.

* * * * *